US006464821B1

(12) United States Patent
Phillips et al.

(10) Patent No.: US 6,464,821 B1
(45) Date of Patent: Oct. 15, 2002

(54) METHOD FOR PREVENTING ADHESION OF MULTI-PART RELEASE LINERS

(75) Inventors: Aaron R. Phillips, Baxter Springs, KS (US); Thomas M. King, Joplin, MO (US)

(73) Assignee: Tamko Roofing Products, Inc., Joplin, MO (US)

( * ) Notice: Subject to any disclaimer, the term of this patent is extended or adjusted under 35 U.S.C. 154(b) by 0 days.

(21) Appl. No.: 09/286,343

(22) Filed: Apr. 5, 1999

Related U.S. Application Data

(62) Division of application No. 08/918,899, filed on Aug. 27, 1997, now Pat. No. 5,916,654.

(51) Int. Cl.[7] ..... B32B 31/00; B32B 3/10

(52) U.S. Cl. ..... 156/304.1; 156/71; 156/247; 156/344

(58) Field of Search ..... 156/304.1, 71, 156/344, 247, 249, 584; 428/41, 40, 42.2, 40.1, 40.3

(56) References Cited

U.S. PATENT DOCUMENTS 2,725,322 A 11/1955 Muttera ..... 428/42.2
3,642,564 A * 2/1972 Walker et al. ..... 161/145
4,374,687 A 2/1983 Yamamoto ..... 428/40.3
4,623,568 A * 11/1986 Suzuki ..... 428/40

* cited by examiner

*Primary Examiner*—Richard Crispino
*Assistant Examiner*—Sue A. Purvis
(74) *Attorney, Agent, or Firm*—Fulbright & Jaworski L.L.P.

(57) ABSTRACT

A method and apparatus for producing a self-adhering product with a multi-part release liner system that will not result in unwanted adhesion at the edges is disclosed. The self-adhering product may be a roofing sheet, or waterproofing membrane. The multi-part release liner system includes a strip of material placed on the adhesive surface below and between each abutting edge of the release liner. The material allows each section of the release liner to be removed without the edges of the liner adhering to the underlying sheet. The release liner may also be a single piece liner, with at least one strip of perforations that allows the liner to be removed in individual sections. In this application, the material not only prevents edge adhesion, but also prevents adhesive from the substrate flowing through the perforation holes. The invention may also be applied to release liner systems that combine multi-part release liners and perforated release liners. The method and apparatus of the invention are applicable to any self-adhesive product that requires a release liner.

8 Claims, 1 Drawing Sheet

METHOD FOR PREVENTING ADHESION OF MULTI-PART RELEASE LINERS

This is a divisional of application Ser. No. 08/918,899, filed Aug. 27, 1997 now U.S. Pat. No. 5,916,654.

BACKGROUND OF THE INVENTION

A. Field of the Invention

The invention relates to articles with adhesive surfaces covered by releasable liners or backings for preserving the adhesive until put into use. More particularly, the invention concerns releasable liners or backings that are more easily and more precisely removed in portions.

B. Background

Roofing sheets are typically applied to an underlying roof surface. Methods of attaching the roofing sheet to the underlying surface include nailing, torching, hot mopping and applying with adhesive backing. Waterproofing sheets may also be applied using adhesive backing.

These roofing and waterproofing sheets are commonly referred to as membranes. Adhesive backed membranes are generally single ply membranes that include an adhesive disposed on the undersurface or a portion of the undersurface. The membrane typically adheres to a substrate, and may also adhere to a portion of another membrane sheet when lapped to form a seam.

The adhesive is generally covered by a releasable backing, commonly referred to as a release liner. The release liner prevents the membrane or sheet from: (1) adhering to itself when the sheet is rolled or stacked; (2) being contaminated during handling; and (3) prematurely adhering to a substrate during application. Characteristics of the release liner are generally determined by the type of adhesive backing applied to the sheet. Typical release liner materials include paper, film, or composite (paper and film) materials. The release liner, whether paper, film, or a composite is typically coated with a release system.

In roofing and waterproofing applications, the release liner is generally unbroken and overlaps the entire width of the sheet. The overlap allows for variability in the manufacturing process and assists in removal of the liner during application of the sheet. For instance, typical roofing or waterproofing sheets are at least 36" wide so the release liner accordingly is at least 37" wide, leaving a ½ inch wide margin or overlap at each edge.

A liner may be coated with a silicone or other suitable release material for facilitating release of the liner from an adhesive. This coating may sometimes be referred to as a release system or release agent. The release system helps to keep a release liner from bonding to an adhesive.

To apply the membrane, the liner is peeled away to expose the adhesive as the sheet is being applied. With a traditional one-piece release liner, this results in several problems. Removing a one-piece liner exposes a large portion of the adhesive to contamination. Dust, dirt, sawdust, insulation fibers and other construction debris may contaminate the adhesive. These contaminants diminish the integrity of the bond between the membrane and the adherent surface.

Another problem is the difficulty an applicator may have removing a large liner without tearing. Tears make it difficult to remove the remaining release liner, and portions that remain on the adhesive reduce the area of adhesion.

An additional problem is folding or wrinkling the membrane. Folding and wrinkling can occur when an applicator pulls the large release liner from the membrane without first securing the membrane. This may cause the membrane to shift and adhere to itself, instead of to the substrate.

A split release liner system was developed to alleviate some of these problems. A split release liner includes two or more adjoining pieces of releasable backing. or a single piece with perforations that allow the liner to be removed in sections. An applicator can peel off one piece or section of the release liner, leaving other sections of the adhesive protected. After positioning the sheet and applying one section with its exposed adhesive, the applicator can then peel off the remaining section of a release liner and apply that portion. This system reduces the risks of contaminating the exposed adhesive and wrinkling the sheet.

Although the split release liner system has improved the installation of adhesive sheets, problems still exist. A release agent is applied to at least one surface of the release liner, whether the release liner comprises paper, film, or a composite, and that surface contacts the adhesive side of a sheet without bonding. Although the release agent resists bonding to the adhesive, the edges of release liners are typically uncoated so the edges may stick to the adhesive. If a split release liner is made by cutting a single-piece sheet, another uncoated edge is created by the cut. These uncoated edges adhere to the adhesive layer of a membrane or other sheet. When the edges adhere, the release liner is difficult to remove causing portions of the release liner to tear and remain on the adhesive surface. These residual portions prevent full adhesion. If the applicator tries to remove the pieces the sheet may be damaged and may be contaminated.

A similar problem results with perforated film release liners. If the perforations are made after a release system is applied, uncoated edges are created. When the release liner is removed, these edges can adhere to the adhesive layer of the sheet. Moreover, the adhesive may flow through the perforations, allowing the sheet to partially adhere to itself prior to application.

SUMMARY OF THE INVENTION

The present invention overcomes many of the limitations and disadvantages associated with known release liner systems, and provides a unique method and apparatus for controlling the adhesion and removal of release liners. For example, the present invention helps reduce unwanted adhesion and contamination of the adhesive.

The present invention comprises amulti-part or multi-section release liner system, that includes at least one strip of material placed between the edges of the liner and the adhesive surface. The strip helps prevent the edges of each release liner section from adhering to the underlying sheet making removal easier.

The strip may be coated with a release system. making it non-bonding and facilitating its removal by an applicator. Alternatively, a coating may be applied to the adhesive itself that is disposed under the edges of the release liner. Even paper or film strip without a release system may be used and left in place after removal of the release liner of the adhesive sheet.

The present invention may also be used with perforated release liners. In this application, strips or coatings are disposed on the adhesive surface below the perforations. These strips or coatings help prevent unwanted adhesion of uncoated edges of the perforated release liner to the adhesive disposed below the perforations. The strips also help prevent adhesive from flowing through the perforations.

Other aspects and advantages of the present invention will become apparent upon reading the following detailed description and upon reference to the drawings.

DESCRIPTION OF ILLUSTRATIVE EMBODIMENTS

Figure 1:
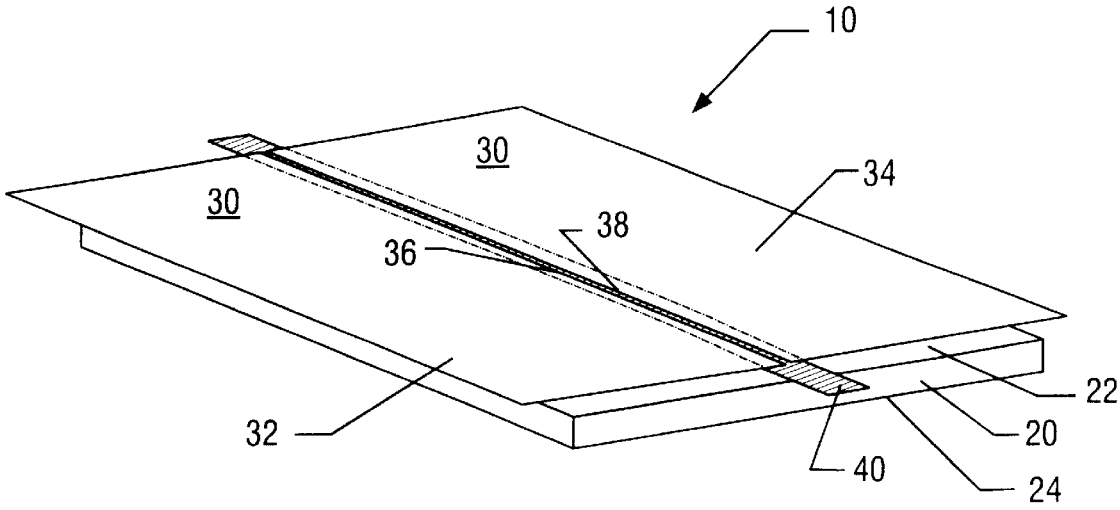
FIG. 1 illustrates a multi-part or multi-section release liner system in accordance with the present invention.

The release liner system 10 is shown in FIG. 1. The system 10 includes sheet 20, release liner 30 and strip 40.

Sheet 20 typically includes a substrate, such as fiberglass or organic felt coated with successive layers of asphalt. Polymer modified adhesive bitumen or other adhesive component is preferably applied to one side of the sheet 20 to form an adhesive layer 22. Granules or other particles are preferably applied to the opposite side to form exposed surface 24.

Release liner 30 may be comprised of various materials such as paper, film or a composite. Preferably the liner 30 is coated with a release agent, or release system. For instance, paper liners 30 are preferably coated on at least one side with a silicone based release system that resists bonding with the adhesive layer 22. The preferred films include high density polyethylene, polypropylene, and polyester, however, other suitable materials may also be used. A silicone based release system is preferred, but other formulations that, when used in conjunction with a certain adhesive will not create an adhesive bond, may also be used.

In the preferred embodiment, the release liner 30 includes multiple liner sections, shown in FIG. 1 as section 32 and section 34. The preferred size of the sections is based on many factors including the size of the sheet 20 and the adhesive area desired to be exposed at one time.

Adhesion of the release liner edges 36 and 38 to the adhesive layer 22 is reduced by the application of strip 40 disposed between the adhesive layer of the roofing sheet and the release liner.

Strip 40 is disposed between the sheet 20 and release liner 30 beneath the intersection of abutting sections (edges 36 and 38). Preferably, strip 40 is placed on the adhesive layer of sheet 20 during the manufacturing process, followed by application of the release liner 30.

Strip 40 acts as a bond breaker between the release liner edges 36 and 38 and the adhesive layer 22, reducing unwanted adhesion. The bond breaker strip may be a film, similar to the films used as release liner substrates. Transparent film is generally preferred because it does not visually indicate a break in the adhesive surface. Also, in general, film is easy to control in the manufacturing process, and certain films may have is enhanced stability at high temperatures.

If a film-type strip 40 is coated with a release system, the applicator has the option to remove the strip 40 prior to adhering the roofing sheet 20 to the adherent surface. However, it is not necessary that the strip 40 be coated or removed.

In embodiments that use an uncoated film as the strip, the strip 40 is typically left in place when the roofing sheet 20 is adhered. In this application, strip 40 is typically between ½" and 2" wide. The segment of the adhesive surface area lost because of the non-bonding strip 40 is a relatively small fraction of the 36" typical width of a roofing sheet. The lost adhesion area is not critical because the system reduces problems associated with installation.

Strips 40 with widths less than ½" may be used, but overlap between the strip 40 and liner edges 36 and 38 would then be less than ¼" per side. With only ¼" of overlap area, the margin of error for misalignment during the manufacturing process is slight. If the roofing sheet 20 slides or moves transverse to the length of the sheet during the process of manufacture, the strip 40 will be out of line with adjacent edges 36 and 38 of the two release liner sections 32 and 34. Greater overlap reduces the problem of uncoated edges adhering, and provides a starting point for removal of the release liner 30.

The width of the strip 40 may be greater than 2" However, a 2" strip provides for a 1" overlap at each of the adjacent edges 36 and 38 of the release liner portions 32 and 34. Adding width to the strip 40 would provide extra starting area for removal of the release liner, but there is little added benefit to this. It is unlikely that manufacturing processes would require a greater margin of error than 2" to insure that the strip and the adjacent edges of the release liner are aligned Additional width would also reduce the adhesion area if a non-releasable strip is used.

Strip 40 may also comprise paper or composite paper and film. Again, the strip 40 could be coated with a release system to allow for removal, or may be uncoated and left in place after installation of the roofing sheet.

Strip 40 may be any material that blocks the effectiveness of the adhesive from adhering to the uncoated edge of the release liner, without reacting to the roofing sheet 20. For example, a layer of fine mineral dust could be applied to the adhesive layer 22. Another example is a silicone based release agent, preferably sprayed onto the adhesive layer 22 to form strip 40. Many other liquid applied coatings, blocking agents, or release agents could be used, provided the area of the adhesive layer 22 that will be aligned with the edges 36 and 38 of the release liner 30 is affected. In addition, the adhesive component may be left off a portion of the adhesive layer 22 to create an integral strip 40.

The placement of the strip 40 may vary with the desired location of the division between the two sections of the release liner 30. In the embodiment of FIG. 1, release liner 30 contains two sections 32 and 34 that are equal in size. The two sections have abutting edges 36 and 38 that create a division or section line centered longitudinally on roofing sheet 20. However, in other embodiments the division may be offset from the centerline, as necessary for specific applications of roofing sheet 20. Preferably, the division is at least three to four inches from the outside edge of the roofing sheet 20. However, in applications where a lap joint is desired between two sheets of a roofing membrane, it may be desirable to have the division less than this distance from the outside edge of roofing sheet 20.

Other embodiments may include release liners 30 that contain three or more distinct sections. In such a multi-part release liner system, there would necessarily be more than one strip 40. For example, if the release liner 30 contained three sections, there would be two breaks between the sections, requiring two strips 40.

After strip 40 has been applied to the adhesive layer of a roofing sheet 20 and the release liner 30 has been applied with each division or section line between the sheet sections aligned with a strip 40, the roofing sheet 20 can be rolled and is ready for application.

During the application process, an applicator can remove release sections 32 and 34 by grasping the overlap at the outside edges of roofing sheet 20 and pulling away the section toward the strip 40, or alternatively by lifting the edge 36 of a release liner section 30 at the location of strip 40. Because this is an unbonded area, the release liner section 32 can be easily lifted, and pulled away toward the outside edge of the roofing sheet 20. In either operation, release liner sections 32 and 34 are prevented from unwanted adhesion at the margins by the strip 40 below, which acts as a bond breaker creating an unbonded area.

Figure 2:
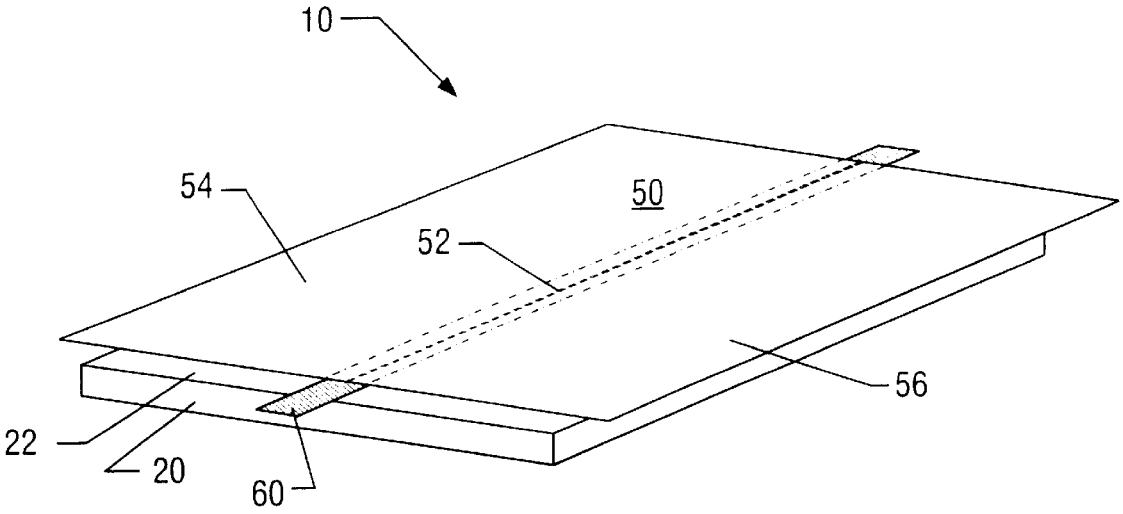
FIG. 2 illustrates a perforated release liner system in accordance with the present invention.

A second embodiment is shown in FIG. 2. The illustrative system 10 includes a roofing sheet 20. In this embodiment, the adhesive layer is covered with a release liner 50 that is of single piece construction, but contains at least one perforation strip 52 that divides the liner 50 into two sections 54 and 56. Preferably, release liner 50 comprises a film coated with a release system. However, the release liner 50 may comprise paper, a paper and film composite, or other suitable material that is resistant to adhesion from the adhesive surface 22.

The perforation strip 52 facilitates separation of the sections 54 and 56 of the release liner 50, allowing them to be removed individually. Release liner 50 could contain additional perforated strips as needed to achieve the desired number of separately removable release liner sections.

A strip 60 is disposed between the adhesive layer of roofing sheet 20 and the release liner 50. The strip 60 is aligned with perforation strip 52. In this embodiment, perforation strip 52 is typically added to the release liner 50 after a side of the release liner is coated with a silicone based release system (or other release agent). As a result, the edges of each perforation hole are uncoated edges. These edges could bond to the adhesive layer 22, but for the presence of non-bonding strip 60. In addition, strip 60 inhibits flow of the adhesive layer 22 through the perforation holes, which would result in the sheet 20 adhering to itself in its rolled form.

Roofing sheets 20 may be waterproofing membranes instead of roofing membranes. For example, self-adhesive sheets of bitumen or butyl based waterproofing are often installed below grade. The sheets are often installed vertically, and as such the adhesive must be very aggressive. It can be difficult for the applicator who must hold the sheet in place for vertical application and remove the release liner at the same time, to obtain a proper bond between the adhesive and the wall or foundation to be waterproofed. If a release liner is reduced from full-width to a multi-part configuration, it is easier for the applicator to remove the liner without tearing it, making installation easier.

A different process is required to establish the configuration of the release liner system for roofing sheets, as shown in FIGS. 1 and 2, and apply it to waterproofing membranes. To manufacture a roofing sheet, asphalts and other materials are layered onto the front and back of a substrate such as felt or fiberglass. Adhesive is layered onto one side and the release liner is disposed on the adhesive. To manufacture a waterproofing membrane, the release liner may act as the substrate. Adhesive may be spread upon the release liner (or other substrate) to achieve a desired quantity of adhesive per unit area, and a waterproofing material added on top.

The difference, therefore, is the position in the manufacturing process that the release liner and strip must be added. In waterproofing manufacture, the release liner and the strip must be added early in the manufacturing process. Because a waterproofing membrane is, in effect, built up on the release liner, perforated film liners are not practical due to flow through the perforation holes. With the addition of the strip this problem is greatly reduced.

All of the other benefits of the apparatus of the invention remain the same in waterproofing and roofing applications. In addition, while the above description is directed to specific roofing and waterproofing sheet membranes, the present invention is applicable to any form of self adhesive materials, such as pressure sensitive tapes, self adhesive sound deadening materials, pipe wrap tapes for sealing joints, waterproofing and insulation tapes, double sided adhesive tapes used for lap joints in roofing, or any other product which requires the removal of a release liner before application.

The description and several embodiments of the present invention are intended as examples of the invention and not as limitations. Many variations may be made to the embodiments disclosed without departing from the scope and spirit of the present invention. The present invention is intended to be limited only by the scope and spirit of the following claims.

What is claimed is:

1. A method for preventing adhesion of the edge portions of a release liner to an asphaltic adhesive substrate, the method comprising:

a) preparing the asphaltic adhesive substrate for attachment of a release liner, the release liner having a plurality of sections, each of the sections having a separating division;

b) coupling at least one non-folded bond breaker strip to the adhesive substrate;

c) aligning the separating division of each of the sections of the release liner with the bond breaker strip;

d) removably attaching the release liner to the asphaltic adhesive substrate such that said at least one bond breaker strip is disposed between the separating division of each of the sections of the release liner and the asphaltic adhesive substrate.

2. The method of claim 1 wherein the release liner is film.

3. The method of claim 2 wherein the separating division is a perforation strip.

4. The method of claim 1 wherein the release liner is paper.

5. The method of claim 4 wherein the separating division is a slit in the release liner.

6. The method of claim 3 wherein the non-folded strip is substantially impermeable to the flow of the asphaltic adhesive substrate.

7. A method for preventing adhesion of a release liner to a substrate that is built upon the release liner, the method comprising the steps of:

a) aligning at least one strip with at least one separation between a plurality of sections of a release liner;

b) positioning the at least one strip above the at least one separation;

c) spreading an adhesive layer upon the release liner, such that the at least one strip is disposed between the release liner and the adhesive layer;

d) coating the adhesive layer with waterproofing material.

8. A method for preparing an asphaltic adhesive coated substrate for application to an adherent surface, comprising the following steps:

a) providing a sectional release liner which is large enough to cover an adhesive coating of the asphaltic adhesive substrate and which is separable into at least two sections along section lines between adjacent said sections;

b) placing non-folded bond breaker strips for assembly between the adhesive coating of the substrate and the release liner along and spanning each section line selected for sectioning of the release liner; and c) assembling the release liner against the adhesive coating of the substrate and each said bond breaker strip.

* * * * *